US010654688B2

(12) United States Patent
Mikkonen et al.

(10) Patent No.: US 10,654,688 B2
(45) Date of Patent: May 19, 2020

(54) ELEVATOR COUNTERWEIGHT

(71) Applicant: KONE Corporation, Helsinki (FI)

(72) Inventors: Janne Mikkonen, Järvenpää (FI); Matti Räsänen, Hyvinkää (FI); Esko Aulanko, Kerava (FI); Jorma Mustalahti, Hyvinkää (FI); Veijo Manninen, Rajamäki (FI); Jari Heikkinen, Hyvinkää (FI); Jarmo Kela, Turenki (FI); Sakari Korvenranta, Hyvinkää (FI); HÅkan Bärneman, Solna (SE)

(73) Assignee: KONE CORPORATION, Helsinki (FI)

( * ) Notice: Subject to any disclaimer, the term of this patent is extended or adjusted under 35 U.S.C. 154(b) by 399 days.

(21) Appl. No.: 15/417,835

(22) Filed: Jan. 27, 2017

(65) Prior Publication Data

US 2017/0217733 A1 Aug. 3, 2017

(30) Foreign Application Priority Data

Jan. 28, 2016 (EP) ..... 16153057

(51) Int. Cl.
*B66B 17/12* (2006.01)

(52) U.S. Cl.
CPC ..... *B66B 17/12* (2013.01)

(58) Field of Classification Search
CPC ..... B66B 17/12
See application file for complete search history.

(56) References Cited

U.S. PATENT DOCUMENTS

| | | | | |
|---|---|---|---|---|
| 8,668,056 | B2 * | 3/2014 | Loiselet | B66B 17/12 187/404 |
| 2004/0094371 | A1 * | 5/2004 | Augugliaro | B66B 17/12 187/404 |
| 2006/0289245 | A1 * | 12/2006 | Asami | B66B 17/12 187/404 |
| 2007/0246307 | A1 * | 10/2007 | Cloux | B66B 17/12 187/404 |
| 2008/0257654 | A1 * | 10/2008 | Milton-Benoit | B66B 5/286 187/404 |
| 2009/0129907 | A1 * | 5/2009 | Huang | B66B 17/12 414/673 |
| 2014/0332325 | A1 * | 11/2014 | Lazaro Goicoechea | B66B 17/12 187/405 |
| 2015/0291396 | A1 * | 10/2015 | Nakamura | B66B 17/12 187/404 |

FOREIGN PATENT DOCUMENTS

| | | | |
|---|---|---|---|
| JP | 10-250959 | A | 9/1998 |
| JP | 2000-302359 | A | 10/2000 |
| JP | 2005-15136 | A | 1/2005 |

* cited by examiner

*Primary Examiner* — Minh Truong
(74) *Attorney, Agent, or Firm* — Birch, Stewart, Kolasch & Birch, LLP

(57) ABSTRACT

A counterweight module, a locking element, a counterweight and a method for assembling a counterweight are disclosed. The counterweight module includes a first part and a second part, between which a straight joint is arranged at right angle in relation to the longitudinal direction of the counterweight module. The counterweight locking element can be used to secure the counterweight modules into a counterweight frame. In the method, the counterweight is filled with balancing modules starting from the bottom of the frame.

17 Claims, 5 Drawing Sheets

ELEVATOR COUNTERWEIGHT

TECHNICAL FIELD

The present disclosure relates to a counterweight module and to a locking element for counterweight modules, a counterweight, and a method for assembling a counterweight. Particularly, the counterweight module and the locking element, the counterweight and the method for assembling a counterweight are intended for elevators.

BACKGROUND OF THE INVENTION

In a traction elevator, a counterweight is used to balance the load of an elevator car, thus reducing power required for the vertical movement of the elevator car. The elevator car and the counterweight are attached to the opposing ends of a hoisting cable and they move reciprocally in the elevator shaft. The movement of the counterweight is usually directed by at least one guide rail, typically by two that are located on two opposing sides of the counterweight.

The counterweight is formed of a metal frame, often including two vertical side beams and two horizontal crossbeams. The weight of the counterweight is adjusted with filler pieces, balancing modules or counterweight modules that are packed within the frame. The counterweight further has an attachment mechanism for the hoisting cable and guide shoes mediating the contact between the counterweight and the guide rails.

The counterweight is placed in the elevator shaft and often space for it, both in vertical and horizontal directions, is limited. At the same time, the counterweight needs to have a sufficient weight in order to perform its balancing ballast function effectively.

Typically, the ballast effect of a counterweight is achieved by filling the metal frame with modules or pieces made of steel or concrete. In order to fit each individual module into the frame between the two side beams, the modules must be inserted at an angle in relation to the side beams and the crossbeams. This means that it is not possible to fill the entire vertical open space of the frame with full length modules. As the frame is filled upwards from the lower crossbeam situated at the bottom of the frame, at a certain point it is no longer possible to angle the modules in order to fit them between the side beams, as the upper crossbeam at the top of the frame prevents sufficient angling of the modules.

As the filling efficiency is thus reduced, unnecessary unfilled or open vertical space within the frame remains. This means that the frame must be made higher in order to fill it with enough of counterweight modules to provide sufficient ballast effect and balance to the elevator, and subsequently, the counterweight requires more space at the upper and lower parts of the elevator shaft.

Earlier, the aforementioned problem has been solved by arranging openings into the upper part of the vertical side beams of the frame, through which the remaining vertical open space may be filled by inserting modules while keeping them level with the crossbeams. The openings affect the structural integrity of the frame.

Alternatively, the remaining vertical open space of the frame may be filled with modules that are shorter than the vertical span between the two side beams, and thus fit between the two side beams in a level position. The shorter modules are then locked onto the frame with separate connectors. With this solution the mass distribution within the counterweight is not symmetric, which affects the balancing function of the counterweight.

Yet another solution is to construct bipartite modules from steel, which are form-locked together as they are inserted into the frame. These kinds of modules are expensive when made of steel, while constructing similar form-locking modules from concrete is very difficult, if not impossible.

SUMMARY OF THE INVENTION

An object of the present invention is to provide a counterweight that has sufficient weight and that requires reduced amount of space in an elevator shaft.

The counterweight module and the locking element, the counterweight and the method for assembling the counterweight are in particular, but not only, intended for elevators, especially for passenger or freight elevators of buildings of different height.

The bipartite counterweight module according to the present disclosure is characterized by comprising a first part and a second part, which together form an elongated rectangular body comprising a first end part and a second end part arranged at the ends of the body in longitudinal direction of the body; and further characterized in that between the first part and the second part, a straight joint is arranged at right angle in relation to the longitudinal direction of the body.

In one embodiment of the invention, the first end part fits into a housing defined by flanges and a connecting wall of a first side beam of a counterweight frame, and the second end part fits into a housing defined by flanges and a connecting wall of a second side beam of the counterweight frame, to secure the counterweight module into the frame.

In one embodiment of the invention, the length of the first part is ¼-¾ of the total length of the counterweight module.

In another embodiment of the invention, the length of the first part is ½ of the total length of the counterweight module.

In one embodiment of the invention, the counterweight module is made by moulding from concrete.

In one embodiment of the invention, the first part and the second part of the counterweight module are made separately by moulding from concrete.

In another aspect of the invention there is disclosed a counterweight locking element for securing the counterweight modules in place in a counterweight frame, comprising an elongated plate part and at least two projections arranged to extend at a right angle from the plate part, which projections form a form-lock between the locking element and the counterweight module.

In one embodiment of the invention, the counterweight locking element secures the first part and the second part of a counterweight module together.

In one embodiment of the invention, the counterweight locking element is made from sheet metal by folding or roll forming.

In another aspect of the invention there is disclosed a counterweight comprising a frame comprising a first vertical side beam, a second vertical side beam, a bottom horizontal crossbeam and a top horizontal crossbeam; an arrangement for attaching hoisting cables onto the frame; and a number of balancing modules, of which balancing modules at least some are counterweight modules according to the invention.

In one embodiment of the invention, the counterweight comprises locking elements arranged between each adjacent counterweight module.

In another embodiment of the invention, the counterweight comprises locking elements arranged between every other counterweight module.

In one embodiment of the invention, the counterweight further comprises a securing element and locking parts for the securing element, with which securing element and locking parts the balancing modules are secured immobile into the frame.

In another aspect of the invention there is disclosed a method for assembling a counterweight, in which method the counterweight is filled with balancing modules starting from the bottom of a frame by inserting a number of first modules at an angle in relation to the horizontal between two side beams; fitting a first end part of the first modules into a housing defined by flanges and a connecting wall of the first side beam; fitting a second end part of the first module into a housing defined by flanges and the connecting wall of the second side beam; and aligning each first module into the horizontal, the first modules being used until a vertical open space between the top-most first module and a top crossbeam of the frame is too small to fit a first modules at an angle between the two side beams; and, thereafter filling the rest of the vertical open space of the frame with counterweight modules until a desired balancing weight of the counterweight is reached; and finally, securing the balancing modules into the frame with a securing element.

In yet another aspect of the invention, there is disclosed an elevator comprising a counterweight according to the invention.

The invention according to the present disclosure offers specific advantages over prior art.

The disclosed counterweight modules are straightforward and cost-efficient to manufacture from concrete because of their simple shape.

Even though the modules may be bipartite, their abutment or joint is completely straight, i.e. no form-lock elements that are difficult to construct from concrete are needed. The two parts of a module are locked together with a simple locking element.

With the disclosed counterweight modules, the entire vertical space between the two side beams and the two crossbeams of the frame can be filled, i.e. the volumetric efficiency of the counterweight is increased without having to increase the height of the frame. In fact, the height of the frame can be reduced, which is especially advantageous in elevator shafts where the vertical and horizontal space for the counterweight is limited.

No additional openings into the side-beams of the frame are needed in order to fill the frame efficiently. This means that the structural strength of the frame is not affected. No costly separate or additional parts or structures for attaching shorter modules onto the frame are needed.

BRIEF DESCRIPTION OF DRAWINGS

The accompanying drawings, which are included to provide a further understanding of the invention, and which constitute a part of this specification, illustrate embodiments of the invention. Together with the description the drawings are meant to help to explain the principles of the invention. The invention is not limited to the specific embodiments illustrated in the drawings.

In the drawings.

DETAILED DESCRIPTION OF THE EMBODIMENTS

Figure 1A:
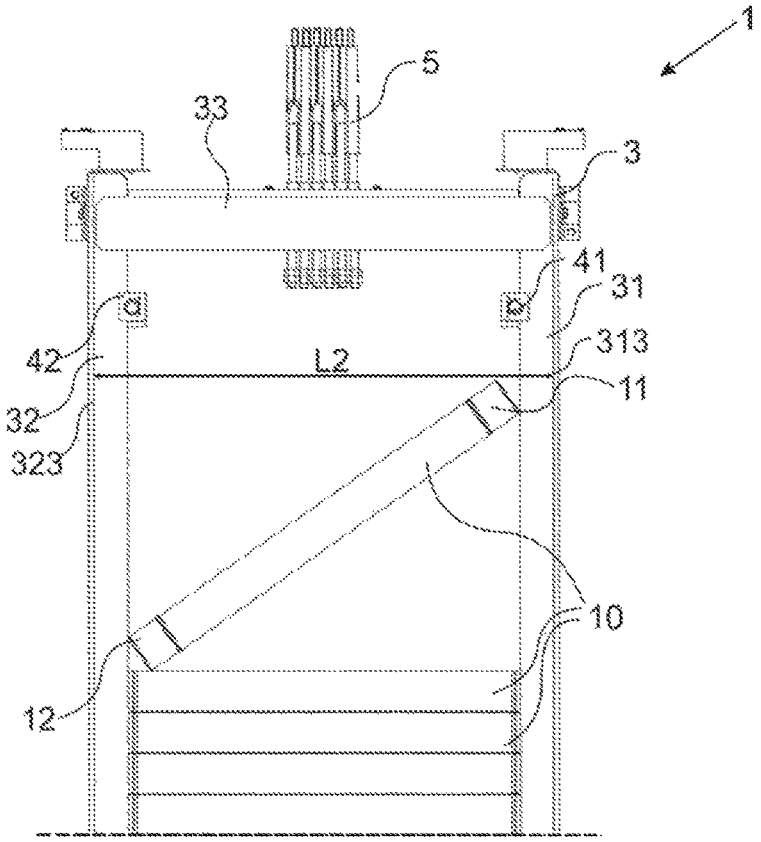
FIG. 1*a* presents a partial view of a counterweight at one stage of its assembly.

The counterweight 1 according to the present invention is presented in FIGS. 1*a*, 2*a*, 3*a*, 4*a* and 5*a*. The counterweight comprises a frame 3 comprising a vertical first side beam 31, a vertical second side beam 32 and two horizontal crossbeams of which only the upper, top crossbeam 33 is shown throughout the accompanying figures. It is to be understood that the bottom crossbeam is arranged between the two side beams 31, 32 at the bottom of the frame 3, extending between the side beams 31, 32 horizontally and in alignment with the top crossbeam 33.

The frame 3 is filled from bottom crossbeam upwards with balancing modules 10, 20. Initially, first modules 10 are used so that the first of the first modules 10 is positioned directly on top of the bottom crossbeam, even though the bottom crossbeam and the bottom-most part of the counterweight 1 is not shown in the figures.

The counterweight 1 further comprises an arrangement 5 for attaching the hoisting cables used for moving the counterweight 1 in relation to an elevator car in an elevator shaft to the frame 3, and locking parts 41, 42 for fastening the counterweight modules in place once the frame 3 is sufficiently filled.

The first modules 10 are inserted into the frame 3 between the two vertical side beams 31, 32 by positioning the first module 10 at an angle divergent from the horizontal as shown in FIG. 1*a*, and inserting a first end part 11 into the side beam 31 and a second end part 12 into the side beam 32, and finally moving the first module 10 to a horizontal position on top of the preceding first module 10 or on top of the bottom crossbeam.

Figure 2A:
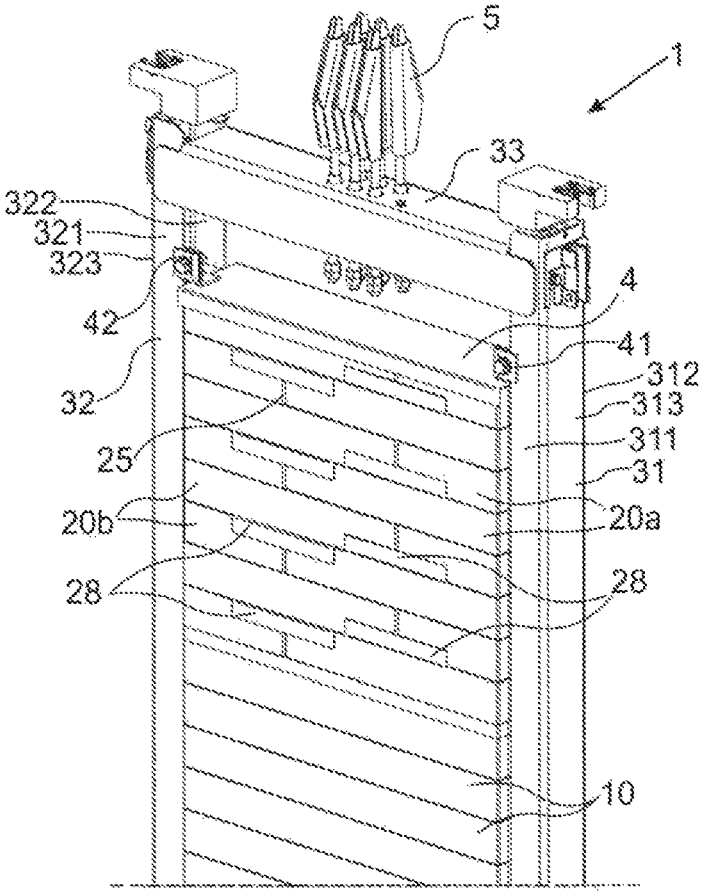
FIG. 2*a* presents a partial view of an embodiment of an elevator counterweight.

The side beams 31, 32 are essentially u-beams, each comprising two flanges 311, 312, 321, 322 and a connecting wall 313, 323 extending between the flanges, thus creating a cross section suitable for receiving the first end part 11 and the second end part 12 (in FIG. 2*a* are presented the details of the side beams 31, 32).

The side beams 31, 32 act as housing for the first end part 11 and a second end part 12 of the first modules 10. As it were, there is a tongue and groove joint formed between the side beams 31, 32 and each individual first module 10 so that the open inner part of the side-beams 31, 32 forms the groove and the first end part 11 and the second end part 12 form the tongues.

Figure 1B:
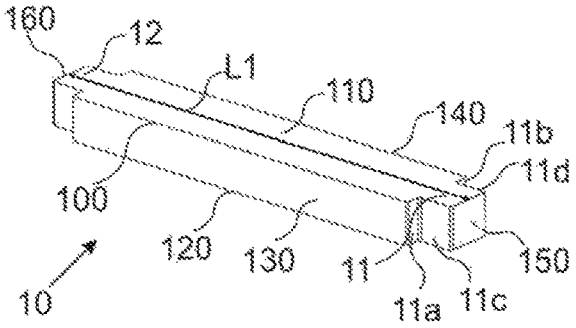
FIG. 1*b* presents a balancing module.

The first module 10 comprises an elongated rectangular body 100 with a block form, made from concrete or any other material suitable for moulding or casting and having a sufficient weight (FIG. 1*b*). By moulding herein is meant the activity of making or forming monolithic pieces from concrete or other such material by placing the concrete or other material in a mould, cast or form of a desired shape to create a desired form out of the concrete or other material. The term moulding is understood to encompass activities such as pouring or casting.

The body 100 of the first module 10 comprises a top face 110, a bottom face 120, a first side face 130 and a second side face 140, and a first end face 150 and a second end face 160. The angles between each two abutting face is a right angle.

The total length L1 of the first module, measured as the distance from a first end face 150 to a second end face 160, is equal to or slightly less than the inner span L2 between the connecting walls 313 and 323 of the side beams 31, 32 (FIG. 1*a*). Length L1 of the first module 10 may be for example 5-30 mm shorter than length L2.

On each end of the first module 10, an end part 11, 12 is arranged. The end parts 11, 12 may be direct extensions of the body 100 with essentially the same width as the body 100. The end parts 11, 12 may be arranged to extend from the body 100.

In FIG. 1*b*, an embodiment of the first module 10 is shown. Only the first end part 11 is presented in detail, but it is to be understood that the second end part 12 corresponds to the first end part 11 as a mirror image. In the embodiment, the first end part 11 comprises two recess planes 11*a* and 11*b* in cross-direction to the length L1 of the first module 10, and two recess planes 11*c* and 11*d* parallel to the length L1 of the first module 10. The end face 150 is also the end face of the first end part 11. The angle between the recess planes 11*a* and 11*c*, and the angle between the recess planes 11*b* and 11*d* is a right angle.

When the first module 10 is installed into the frame 3 and rests horizontally on top of the previous first module 10 (or on top of the bottom crossbeam), the recess planes 11*c*, 11*d* of the first end part 11 are positioned between the inner sides of the wings 311, 322 of the side beam 31. The corresponding recess planes of the second end part 12 are positioned between the inner sides of the wings 321, 322 of the side beam 32.

The corners between the first side face 130 and the first recess plane 11*a*, between the second side face 140 and the second recess plane 11*b*, between the first recess plane 11*b* and the third recess plane 11*c*, between the second recess plane 11 b and the fourth recess plane 11*d*, between the third recess plane 11*c* and the first end face 150, and between the fourth recess plane lid and the first end face 150 (similarly, the corners between the corresponding parts of the second end part 12) may be bevelled or rounded.

Figure 1C:
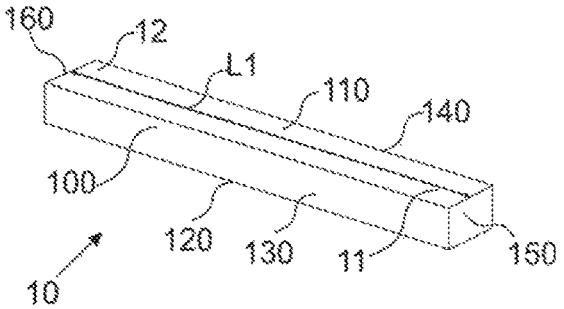
FIG. 1*c* presents another embodiment of a balancing module.

In an embodiment (FIG. 1*c*) of the first module 10, the end parts 11, 12 may be arranged to the longitudinal ends of the body 100 without any recess planes 11*a-d*. In that case, the body 100 and the end parts 11, 12 together form a rectangular block form. The first and second side faces 130, 140 of the body 100 continue as first and second side faces of the end parts 11, 12. When the first module 10 is installed into the frame 3 and rests horizontally on top of the previous first module 10 (or on top of the bottom crossbeam), the side faces 130, 140 of the body 100 and the first end part 11 are positioned between the inner sides of the wings 311, 322 of the side beam 31. The corresponding side faces 130, 140 of the body and the second end part 12 are positioned between the inner sides of the wings 321, 322 of the side beam 32.

The counterweight frame 3 may be filled with first modules 10 up to a point where it is no longer possible to fit an angled first module 10 between the two side beams 31, 32 because the open vertical space between the lastly inserted first module 10 and the top crossbeam 33 is too small. Thereafter, counterweight modules 20, 201, 202, 203, 204 may be used (FIGS. 2*a*-5*d*).

The counterweight module 20 is essentially identical to the first module 10 in shape and dimensions (see for example FIGS. 1*b*, 2*b* and 3*b*), as well as in material. The counterweight module 20 comprises an elongated rectangular body 200 and a first end part 21 and a second end part 22 arranged as direct extensions of the body 200 and/or extending from the ends of the body 200 in the longitudinal direction of the body 200.

Further, the body 200 comprises a top face 110, a bottom face 120, a first side face 130 and a second side face 140 (the aforementioned parts are not shown in FIGS. 2*b*, 3*b*, but they correspond to the similar parts of the first module 10 as presented in FIG. 1*b*), and a first end face 150 and a second end face 160. The angles between each two abutting face is a right angle.

The total length L1 of the first module 10 or the counterweight module 20, measured as the distance from a first end face 150 to a second end face 160, is equal to or slightly less than the inner span L2 between the connecting walls 313 and 323 of the side beams 31, 32 (as shown in FIG. 1*a*). Length L1 of the first module 10 or the counterweight module 20 may be for example 5-30 mm shorter than length L2.

Contrary to the first module 10, the counterweight module 20 is bipartite, i.e. it is arranged into two parts 20*a*, 20*b* so that a straight joint 25, arranged at a right angle in relation to the longitudinal direction or length L1 of the counterweight modules 20, is formed between the two parts 20*a*, 20*b*.

In other words, the counterweight module 20 corresponds to the first module 10 divided into two pieces with a straight cut, even though the two parts 20*a*, 20*b* may be moulded or cast separately instead of actually cutting a first module 10 into two pieces.

In FIG. 2*a-d*, an embodiment of the counterweight 1 is shown. The bottom part of the frame 3 is first filled with first modules 10, as explained above. The upper part of the frame 3 is then filled up with counterweight modules 20, each comprising a first part 20*a* and a second part 20*b*, which are held together with a locking element 28 once the two parts 20*a*, 20*b* are inserted into the frame. The locking element 28 also holds two adjacent counterweight modules 20 together.

There is a butt joint or plain edge joint 25 between the first part 20*a* and the second part 20*b* at a point where the two parts 20*a*, 20*b* abut and contact each other when placed into the frame 3. This kind of bipartite module structure is very simple to mould or cast from concrete or any other suitable material since there is no complicated form joint or structural joint at the joint 25.

At the opposite end to the joint 25, the first part 20*a* of the counterweight module 20 has a first end part 21 similar to that of the first end part 11 of the first module 10. Likewise, at the opposite end to the joint 25, the second part 20*b* of the counterweight module 20 has a second end part 22 similar to that of the second end part 12 of the first module.

The structure and dimensions of the first end parts 11, 21 are identical in the two modules 10, 20, as are those of the end parts 12, 22. The latter are naturally mirror images of the first, as explained earlier in connection with the first module 10. For the sake of simplicity, the first end part 21 and the second end part 22 are herein referred to as first and second end parts of the counterweight module 20.

Figure 3A:
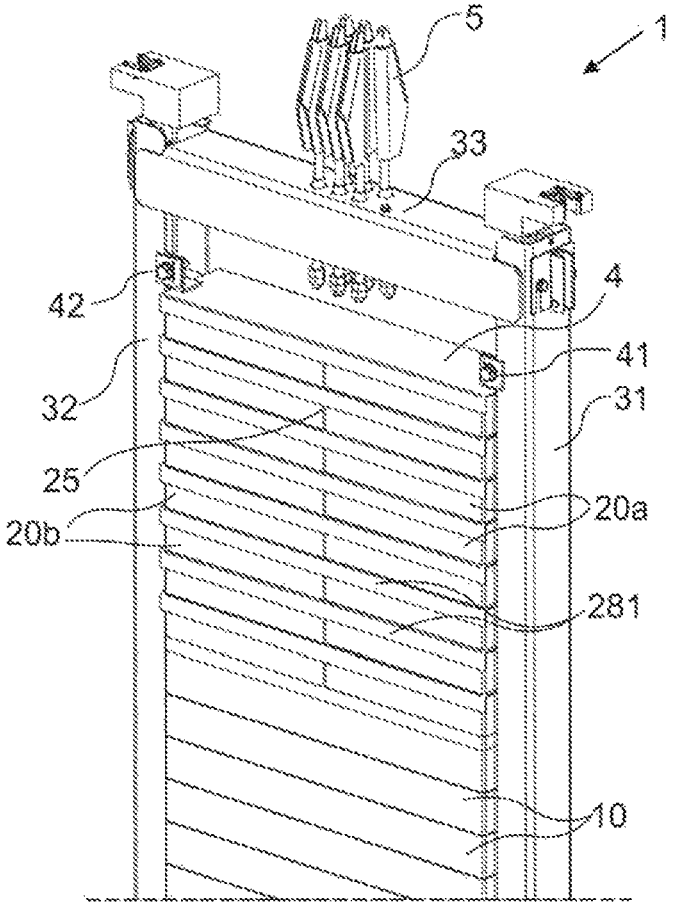
FIG. 3*a* presents a partial view of an embodiment of an elevator counterweight.
Figure 3B:
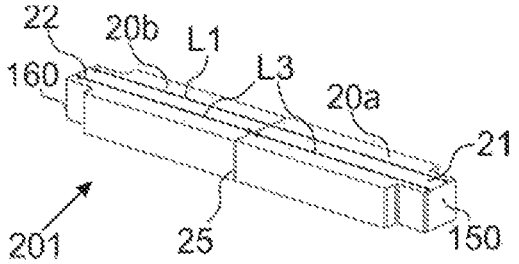
FIG. 3*b* presents another embodiment of a counterweight module.

In one embodiment, the counterweight module 20 may be divided into two parts 20*a*, 20*b* identical in length (for example FIG. 3*b*). In other words, the counterweight module 20 corresponds to the first module 10 divided in half, the length L3 of each part 20*a*, 20*b*, measured as the distance from the joint 25 to the end faces 150, 160 of the counterweight module 201, representing ½ of the total length L1 of the counterweight module 20.

Figure 2B:
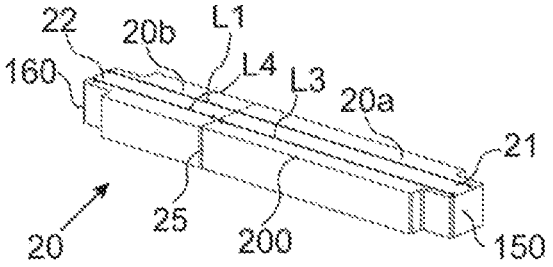
FIG. 2*b* presents an embodiment of a counterweight module.

In another embodiment, the counterweight module 20 may be divided into two parts 20*a*, 20*b* of different lengths L3, L4 (FIG. 2*b*). In one embodiment, the length L3 of the first part 20*a*, measured as the distance from the joint 25 to the first end face 150 of the counterweight module 20, may be ⅔ of the total length L1 of the counterweight module 20 for every other or alternate counterweight module 20; and ⅓ of the total length L1 of the counterweight module 20 for the counterweight modules 20 between the first mentioned, when the counterweight modules 20 are stacked into the frame 3.

In that case, the length L4 of the second part 20*b*, as measured from the joint 25 to the second end face 160 of the counterweight module 20, is ⅓ of the total length L1 of the counterweight module 20 for every other counterweight module 20; and ⅔ of the total length L1 of the counterweight module 20 for the counterweight modules 20 between the first mentioned. This arrangement of the alternate different counterweight modules 20 into the frame 3 is best seen in FIG. 2*a*.

The ratio of L3 to L1, or L4 to L1, may vary from 1/4 to 3/4.

In order to secure 1) the bipartite counterweight module 20 into the frame 3 of the counterweight 1, 2) each adjacent counterweight module 20 to the module next to it, and 3) the two pieces 20*a*, 20*b* of each counterweight module 20 together, a simple locking element 28, 281, 282, 283 may be used.

A form-lock is formed between the counterweight module 20 (or the two parts 20*a*, 20*b* of the counterweight module 20) and the locking element 28, 281, 282, 283. By form-lock is meant a coupling or connection where the contacting surfaces of the locking element 28, 281, 282, 283, when arranged into contact with the side faces 130, 140 of the counterweight module 20, hold the parts 20*a*, 20*b* in place. In other words, projections 28*a-d*, 281*a-b*, 282*a-b*, 283*a-b* are arranged into contact with the counterweight module 20 so that their inner surfaces are able to hold the parts 20*a*, 20*b* in place. In essence, in form-lock the connection or interlocking between two or more separate parts together is based on the form of the locking element part and the parts connecting to the locking element.

Figure 2C:
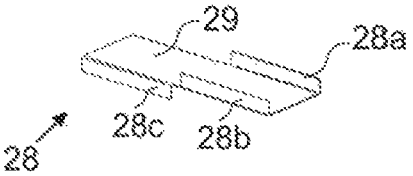
FIG. 2*c* presents an embodiment of a counterweight module locking element.
Figure 3C:
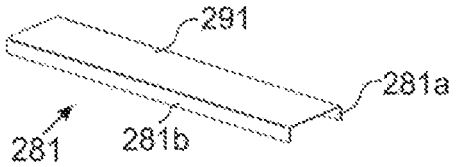
FIG. 3*c* presents an embodiment of a counterweight module locking element.
Figure 4A:
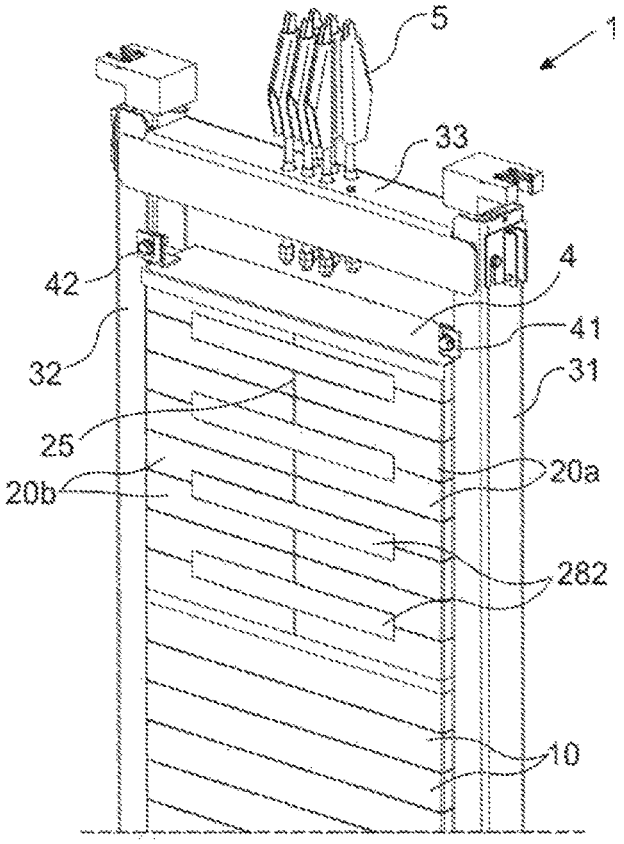
FIG. 4*a* presents a partial view of an embodiment of an elevator counterweight.
Figure 4B:
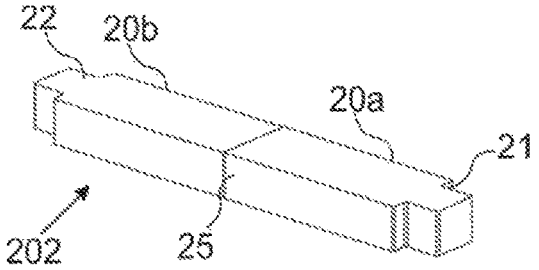
FIG. 4*b* presents another embodiment of a counterweight module.
Figure 4C:
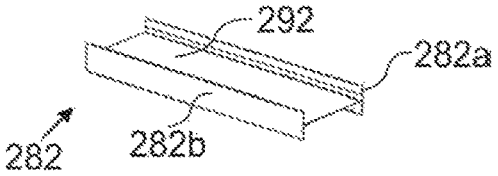
FIG. 4*c* presents an embodiment of a counterweight module locking element.
Figure 4D:
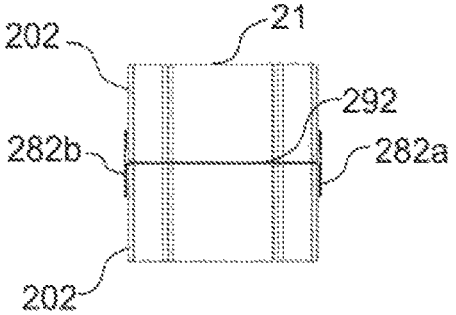
FIG. 4*d* presents a partial side view of the counterweight of FIG. 4*a*.
Figure 5A:
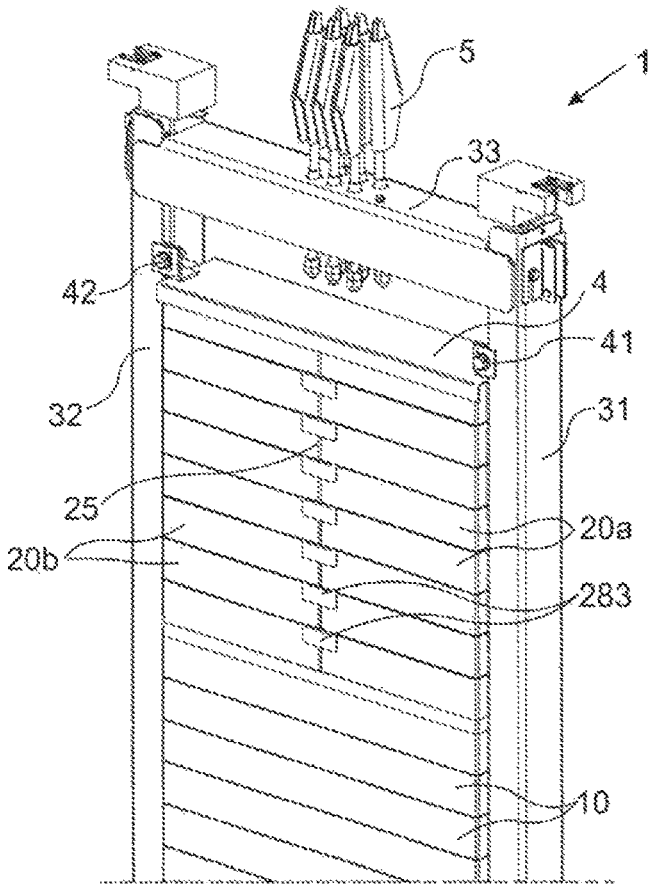
FIG. 5*a* presents a partial view of an embodiment of an elevator counterweight.
Figure 5B:
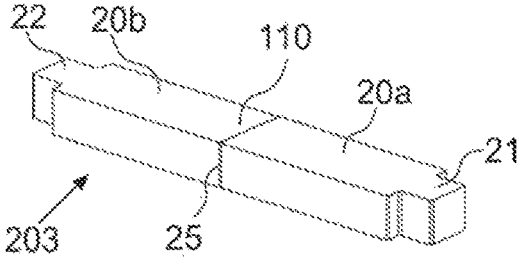
FIG. 5*b* presents an embodiment of a counterweight module.
Figure 5C:
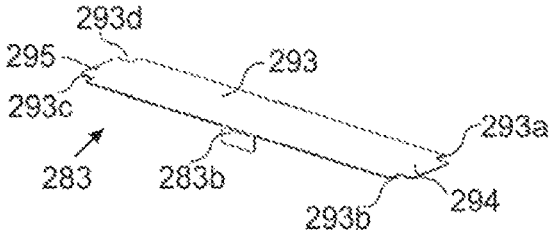
FIG. 5*c* presents an embodiment of a counterweight module locking element.
Figure 5D:
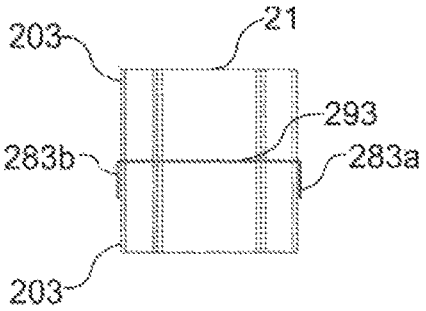
FIG. 5*d* presents a partial side view of the counterweight of FIG. 5*a*.

The locking element 28, 281, 283 is made for example from thin sheet metal or sheet plate by folding (see FIGS. 2*c*, 3*c* and 5*c*). In an embodiment, the locking element 282 may be constructed from reeled metal band by roll forming (FIG. 4*c*). Also other materials such as plastics or composite materials, and other construction methods suitable for the chosen material may be utilised.

In one embodiment (as presented in FIGS. 2*a-d*), the locking element 28 comprises an elongated plate part 29 from which four projections 28*a-d* are bent to extend at an essentially right angle either upwards (first and second projections 28*a*, 28*b*) or downwards (third and fourth projections 28*c*, 29*d*) from the plate part 29 to form a locking element 28 that can secure two adjacent counterweight modules 20 together at the vicinity of the joint 25.

The length of the projections 28*a-d* in the longitudinal direction of the plate part 29 and the horizontal direction of the counterweight modules 20 is about ½ of the length of the plate part 29. In the embodiment of FIGS. 2*a-d*, the locking elements 29 need to be arranged only between every other adjoining counterweight module 20 in order to reach a sufficiently rigid and strong structure for the counterweight 1.

Figure 2D:
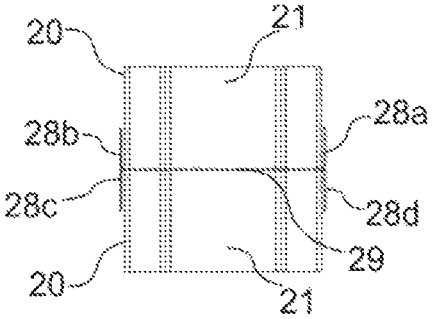
FIG. 2*d* presents a partial side view of the counterweight of FIG. 2*a*.

In FIG. 2*d*, a partial view as seen from the direction of the side-beam 31 (side-beam 31 is not shown for the sake of clarity) shows two adjacent counterweight modules 20, one on top of the other. A locking element 28 is arranged between the two counterweight modules 20, and the upwards extending first and second projections 28*a*, 28*b* secure the upper counterweight module 20, while the downwards extending third and fourth projections 28*c*, 28*d* secure the lower counterweight module 20.

The lengths L3, L4 of the first and second parts 20*a*, 20*b* of the counterweight module 20, and the length of the locking element 28 are so chosen as to enable securing of two adjacent counterweight modules 20 with a locking element 28 even though their joints 25 are not in line vertically due to the different lengths L3 and L4 of each part 20*a*, 20*b* of adjacent counterweight modules 20.

As can be seen from FIGS. 2*d*, 3*d*, 4*d*, 5*d*, the width of the plate part 29 of the locking element 28, 281, 282, 283 is essentially equal to or slightly less than the width of the counterweight module 20, in order to hold the counterweight module 20 snugly and securely.

For example the wight of the plate part 29, 291, 292, 293 may be 3 mm wider than the width of the counterweight module 20 to allow for width variations in the counterweight module 20 due to manufacture process. The width of the plate part 29, 291, 292, 293 may be 0-5 mm wider than width of the counterweight element 20.

Typically, the manufacturing tolerance achieved by the counterweight modules 20 from concrete is +/−2.0 mm for the width of the module. Therefore it is necessary for the width of the plate part 29, 291, 292, 293 of the locking element 28, 281, 282, 292 to be slightly wider. Due to the nature of the material from which the locking element 28, 281, 282, 283 is made, a form-lock can be arranged between the locking element and the counterweight module even though the above-mentioned measurements are not entirely exact.

The projections 28*a-d*, as they are made from thin metal, yield slightly. Thus, when installing the parts 20*a*, 20*b* of the counterweight module 20 into the frame 3 and the locking element 28 between two adjacent counterweight modules 20, a form-lock is created between the two parts 20*a*, 20*b* of the counterweight module 20 and the locking part 28, and between the two parts 20*a*, 20*b* of the adjacent counterweight module 20 and the locking part 28.

In another embodiment, a locking element 281 is arranged between each adjacent counterweight module 201 (FIGS. 3*a-d*). The locking element 281 comprises an elongated plate part 291 essentially equal to the width of the counterweight module 201, and two projections 281*a*, 281*b* bent to extend at an essentially right angle either downwards as shown in FIG. 3*c* or upwards (not shown).

The length of the locking element 281 is equal to the length of the counterweight module 201 measured from the first recess planes 11*a*, 11*b* of the first end part 21 (the recess planes are shown in FIG. 1*b* for the first module 10, and they correspond to the recess planes of the first end parts 21 of the counterweight modules 20, 201, 202, 203); and the first recess planes of the second end part 22 (not shown). In other words, the length of the locking element 281 corresponds to the length of the open horizontal space between the two side-beams 31, 32.

The locking element 281 can be made for example by folding from thin sheet metal or sheet plate.

Figure 3D:
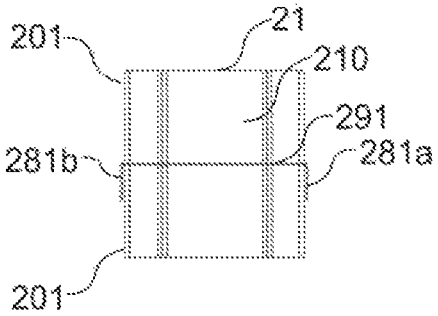
FIG. 3*d* presents a partial side view of the counterweight of FIG. 3*a*.

In FIGS. 3*a* and 3*d* is shown how the locking element 281, when placed between two adjacent counterweight modules 201, holds the two parts 20*a*, 20*b* of the counterweight module 201 together between the two projections 281*a*, 282*a*. Also here, the slight yield of the thin metal material of the locking element 281 allows a form-lock to be formed between the two parts 20*a*, 20*b* of the counterweight module 201 and the two projections 281*a*, 281*b* of the locking element 281.

In yet another embodiment, a locking element 282 is arranged between every other adjacent counterweight module 202 (FIGS. 4*a-d*). The locking element 282 comprises an elongated plate part 292 essentially equal to the width of the counterweight module 202, and two projections 282*a*, 282*b* formed by roll forming from, for example, reeled thin metal band. The projections 282*a*, 282*b* are formed so that the longer edges of the plate part 292 first extend downwards at a right angle, the turn to extend essentially 360° upwards to protrude over the level of the plate part 292 and finally extend again essentially 360° downwards to strengthen the structure and allow a firm form-lock to be formed between the locking element 282 and the counterweight module 202 (see FIG. 4*d*). This kind of structure of the locking element 282 is sufficiently rigid so that a locking element 282 is only needed between every other counterweight module 202, as can be seen from FIG. 4*a*.

In one embodiment, a locking element 283 comprises an elongated plate part 293 to which two projections 283*a*, 283*b*, and four cut-outs 293*a-d* from each four corners of the plate part 293, are arranged (FIG. 5*a-d*). The projections 283*a*, 283*b* are bent to extend downwards or upwards from the plate part 293 at a right angle.

The dimensions of the plate part 293 of the locking element 283 correspond to the dimensions of a top face 110 of the counterweight module 203. The cut-outs 293*a-d* form two end parts 294, 295 to the locking element 293, which correspond to the end parts 21, 22 of the counterweight module 203.

The projections 283*a*, 283*b* are arranged at the vicinity of the middle point of the longest edges of the locking element 283 in the longitudinal direction of the locking element 283. Thus the projections 283*a*, 283*b* are situated adjacent to the joint 25 between the two parts 20*a*, 20*b* once the locking element 283 is placed on top of a counterweight module 20 inserted into the frame 3. This way, the locking element 283 holds together the two parts 20*a*, 20*b* of the counterweight module 203 at their joint 25.

The end parts 284, 285 of the locking element 283 are positioned into the housing inside the two side beams 31, 32 together with the end parts 21, 22 of the counterweight module 203, which further strengthens the structure of the counterweight in this embodiment.

A locking element 283 is arranged between each adjacent counterweight module 203. The locking element 283 may be constructed from thin sheet metal or sheet plate by bending and cutting.

In each embodiment, once the final counterweight module 20, 201, 202, 203 has been installed into the frame 3, a retainer 4 is lastly placed on top of the top-most counterweight module 20, 201, 202, 203 (FIGS. 2*a*, 3*a*, 4*a*, 5*a*). The retainer 4 ensures that all of the modules 10, 20, 201, 202, 203 stay in place within the frame 3 and cannot move in vertical direction of the frame 3 when the counterweight 1 moves up and down in the vertical direction of the elevator shaft.

The retainer 4 may be a metal plate or beam essentially rectangular in shape, which can be fitted between the two side beams 31, 32. From the longer edges of the plate, two wings or projections may be arranged to protrude downwards at an essentially right angle, so that the retainer 4 fits over the top-most counterweight module 20 to envelope at least the top face 110 and preferably at least partially the two side faces 130 and 140 of the counterweight module 20.

The retainer 4 is secured in place with the locking parts 41, 42 that can be detachably secured to the side beams 31, 32. The locking parts 41, 42 can be for example angle irons that are moveably arranged, and detachably tightened onto the flanges 311, 321 of the side beams 31, 32 with for example a nut-and-bolt arrangement, spring, hook-and-bolt arrangement, or any other suitable releasable securing element.

In the method for assembling a counterweight 1, the counterweight frame 3 is filled, starting from the bottom of the frame 3 at the bottom crossbeam (not shown in the figures) by inserting a desired number of first modules 10 at an angle in relation to the horizontal between the two side beams 31, 32 (FIG. 1*a*). The first end part 11 of the first module 10 is fitted into a housing defined by the flanges 311, 312 and the connecting wall 313 of the side beam 31, and the second end part 12 of the first module 10 is fitted into a housing defined by the flanges 321, 322 and the connecting wall 323 of the side beam 32. Thereafter, the first module is moved into a horizontal position between the two side beams 31, 32. The side beams 31, 32 hold the first module 10 in place.

The next first module 10 is placed in the same manner to rest on top of the previous first module until no more first modules 10 can be fitted into the frame 3 because the vertical open space between the top-most first module 10 and the top crossbeam 33 is no longer large enough to accommodate a first module 10 at an angle required to place it unhindered between the two side beams 31, 32. Thereafter, the rest of the open vertical space of the frame 3 may be filled with bipartite counterweight modules 20 (FIG. 2*a*).

The first part 20*a* and the second part 20*b* of a counterweight module 20 are both placed on top of the previous first module 10 or previous counterweight module 20 so that the first end part 21 of the counterweight module 20 is inserted into the first side beam 31 as similarly as has been described above in connection to the first module 10. The second end part 22 of the counterweight module 20 is likewise inserted into the second side beam 32. The first part 20*a* and the second part 20*b* of the counterweight module 20 are thus aligned to abut each other at the joint 25 at which a straight butt joint or plain edge joint is thus formed.

In order to secure the two parts 20*a*, 20*b* together, and to secure two adjacent counterweight modules 20 together, a locking element 28, 282, 282, 283 is placed between every adjacent counterweight modules 20 or between every other counterweight modules 20, depending on the design of the counterweight modules 20 and the locking element 28. The locking element 28, 282, 282, 283 can be placed in the vicinity. of the joint 25, or it can cover essentially the whole horizontal length of the counterweight module 20.

A form-lock is formed between projections 28*a-d*, 281*a-b*, 282*a-b*, 283*a-b* of the locking element 28, 282, 282, 283 and the first and second parts 20*a*, 20*b* of the counterweight module, as well as between the locking element and two adjacent counterweight modules 20. Thus the locking element 28, 282, 282, 283 ensures that the adjacent counterweight modules 20 stay in place in the vertical stack of counterweight modules 20 within the frame 3.

When the counterweight 1 has a desired number of modules 10, 20 arranged into the frame 3, a retainer 4 is placed on top of the top-most counterweight module 20 (FIGS. 2*a*, 3*a*, 4*a*, 5*a*), and secured into the frame 3 via locking parts 41, 42 that are detachably secured into the side beams 31, 32, or into the flanges 311, 321 of the side beams 31, 32. The retainer 4 ensures that the stack of modules 10, 20 remains stable within the frame 3 when the counterweight 1 is in motion.

In an elevator according to the invention, the elevator comprises the counterweight (1) described above. The counterweight (1) comprises a frame 3 with a vertical first side beam 31, a vertical second side beam 32 and two horizontal crossbeams.

The frame 3 is filled from bottom crossbeam upwards with balancing modules 10, 20. Initially, first modules 10 are used so that the first of the first modules 10 is positioned directly on top of the bottom crossbeam. Further, at least some of the balancing modules 10, 20 are counterweight modules 20 as described herein. The counterweight 1 may have locking elements 28, 281, 282, 283 between each adjacent counterweight module 20 or between every other adjacent counterweight module 20.

The counterweight 1 may be assembled as described above in connection with the method for assembling a counterweight.

The counterweight 1 further comprises an arrangement 5 for attaching the hoisting cables used for moving the counterweight 1 in relation to an elevator car in an elevator shaft to the frame 3, and locking parts 41, 42 for fastening the counterweight modules in place once the frame 3 is sufficiently filled.

The elevator herein may be any kind of elevator or elevator system known in the art.

The above embodiments are to be understood as illustrative examples of the invention. Further embodiments of the inventions can be conceived. It is to be understood that any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A counterweight module system comprising:

at least two counterweight modules, each counterweight module comprising:

a first part and a second part, which together form an elongated rectangular body comprising a first end part and a second end part arranged at ends of the body in a longitudinal direction of the body, wherein between the first part and the second part, a straight joint is arranged at a right angle in relation to the longitudinal direction of the body, wherein the straight joint is a straight line extending an entire width of the body, and wherein the first end part and the second end part are respectively protruding from the first part and the second part, and are in mirror-image symmetry; and a counterweight locking element for securing the at least two counterweight modules in place in a counterweight frame, the counterweight locking element comprising:

an elongated plate part; and at least two projections arranged to extend at a right angle from the elongated plate part, wherein the projections form a form-lock between the locking element and the counterweight module, wherein the counterweight locking element is placed between the at least two counterweight modules with the projections contacting at least one longitudinal side surface, at the straight joint, of at least one of the at least two counterweight modules.

2. The counterweight module according to claim 1, wherein the first end part fits into a housing defined by flanges and a connecting wall of a first side beam of the counterweight frame, and wherein the second end part fits into a housing defined by flanges and a connecting wall of a second side beam of the counterweight frame, to secure the counterweight module into the frame.

3. The counterweight module according to claim 2, wherein the length of the first part is ¼-¾ of the total length of the counterweight module.

4. The counterweight module according to claim 2, wherein the length of the first part is ½ of the total length of the counterweight module.

5. The counterweight module according to claim 2, wherein the counterweight module is made by moulding from concrete.

6. The counterweight module according to claim 1, wherein the length of the first part is ¼-¾ of the total length of the counterweight module.

7. The counterweight module according to claim 6, wherein the length of the first part is ½ of the total length of the counterweight module.

8. The counterweight module according to claim 6, wherein the counterweight module is made by moulding from concrete.

9. The counterweight module according to claim 1, wherein the length of the first part is ½ of the total length of the counterweight module.

10. The counterweight module according to claim 1, wherein the counterweight module is made by moulding from concrete.

11. The counterweight module according to claim 1, wherein the first part and the second part of the counterweight module are made separately by moulding from concrete.

12. The counterweight locking element according to claim 1, wherein the counterweight locking element secures the first part and the second part of a counterweight module together.

13. The counterweight locking element according to claim 1, wherein the counterweight locking element is made from sheet metal by folding or roll forming.

14. A counterweight comprising:

a frame comprising a first vertical side beam, a second vertical side beam, a bottom horizontal crossbeam and a top horizontal crossbeam;

an arrangement for attaching hoisting cables onto the frame;

a number of balancing modules, wherein at least some of the balancing modules comprise:

a first part and a second part, which together form an elongated rectangular body comprising a first end part and a second end part arranged at ends of the body in a longitudinal direction of the body, wherein between the first part and the second part, a straight joint is arranged at a right angle in relation to the longitudinal direction of the body, wherein the straight joint is a straight line extending an entire width of the body, and wherein the first end part and the second end part are respectively protruding from the first part and the second part, and are in mirror-image symmetry; and locking elements arranged between every other counterweight module.

15. The counterweight according to claim 14, further comprising a securing element and locking parts for the securing element, wherein the securing element is placed on top of the number of balancing modules and secured to the frame via the locking parts, such that the number of balancing modules are secured immobile into the frame.

16. A method for assembling the counterweight according to claim 14, wherein the counterweight is filled with balancing modules starting from the bottom of the frame by:

inserting a number of first modules at an angle in relation to the horizontal between two side beams of the frame;

fitting a first end part of the first modules into a housing defined by flanges and a connecting wall of the first side beam;

fitting a second end part of the first module into a housing defined by flanges and a connecting wall of the second side beam;

aligning each of the number of first modules with the horizontal, the first modules being used until a vertical open space between the top-most first module and a top crossbeam of the counterweight frame is too small to fit the first modules at an angle between the two side beams; and thereafter, filling the rest of the vertical open space of the frame with counterweight modules until a desired balancing weight of the counterweight is reached, and finally, securing the balancing modules into the frame with a securing element.

17. An elevator comprising the counterweight according to claim 14.

* * * * *